United States Patent [19]

Sato et al.

[11] Patent Number: 4,462,173

[45] Date of Patent: Jul. 31, 1984

[54] RADIATION BASE OF AN ELECTRIC APPLIANCE

[75] Inventors: Isao Sato; Kōsaku Nakajima, both of Kamo, Japan

[73] Assignee: Toshiba Heating Appliances Co., Ltd., Niigata, Japan

[21] Appl. No.: 306,230

[22] Filed: Sep. 28, 1981

[30] Foreign Application Priority Data

Sep. 26, 1980 [JP] Japan ..... 55-134067

[51] Int. Cl.[3] ..... D06F 75/38

[52] U.S. Cl. ..... 38/93; 428/139

[58] Field of Search ..... 38/93, 77.9; 428/422, 428/139, 140, 138; 219/245, 258; 425/543, 129 R; 264/274, 279

[56] References Cited

U.S. PATENT DOCUMENTS

| | | | |
|---|---|---|---|
| 2,427,144 | 9/1947 | Jansen | 264/274 X |
| 3,142,916 | 8/1964 | Jacobson | 38/93 X |
| 3,181,990 | 5/1965 | Reiling | 428/139 |
| 3,480,461 | 11/1969 | Lynge | 38/93 X |
| 3,502,767 | 3/1970 | Morrison et al. | 425/543 X |
| 3,507,739 | 4/1970 | Jacobs | 428/139 |
| 3,855,029 | 12/1974 | Sabel | 264/274 X |
| 4,004,774 | 1/1977 | Houston | 428/139 X |
| 4,064,300 | 12/1977 | Bhangu | 428/138 X |
| 4,233,763 | 11/1980 | McMullen | 38/93 X |
| 4,248,915 | 2/1981 | Vinciguerra | 428/422 X |

FOREIGN PATENT DOCUMENTS

| | | | |
|---|---|---|---|
| 2029994 | 10/1970 | France | 428/139 |

*Primary Examiner*—Henry Jaudon
*Assistant Examiner*—Andrew M. Falik
*Attorney, Agent, or Firm*—Oblon, Fisher, Spivak, McClelland & Maier

[57] ABSTRACT

A radiation base of an iron comprises a baseplate, and an injection-molded layer integrally attached to one side of said baseplate, the layer being formed of synthetic resin with low friction properties, nonviscousness and heat resistance, such as polyphenylene sulfide resin, phenolic resin or fluoric resin.

2 Claims, 8 Drawing Figures

RADIATION BASE OF AN ELECTRIC APPLIANCE

BACKGROUND OF THE INVENTION

This invention relates to a radiation base of an electric appliance such as an iron or cooking plate.

In general, radiation bases of this kind are formed as follows. First, a baseplate is molded by aluminum die casting. The surface of the baseplate is machined smooth, and then roughed by sandblasting or other means. After going through degreasing, baking and other processes, the surface is coated with fluoric resin, and the resin is fired to form a film layer which is to be used as a heat radiating surface. Having low friction property, nonviscousness and resistance to chemicals and heat, the film layer formed of fluoric resin can be applied to the heat radiating surface of an iron or cooking plate.

Moldings produced by the die casting method, howeverm, are by nature liable to setting wrinkles or blowholes. Accordingly, when the baseplate molded by aluminum die casting is machined or cut, the cut surface of the baseplate may involve setting wrinkles or blowholes, complicating the fluoric resin coating. As a result, the baseplate must sometimes be rejected as a defective. Further, the coating and firing of fluoric resin would require extensive equipment and substantial working time, resulting in an increase in cost. Moreover, the fluoric resin film layer can have a thickness of 50$\mu$ at the most due to the restrictions on the resin coating. When used as the heat radiating surface of an iron or cooking plate, therefore, the film layer may possibly be worn out to expose the surface of the baseplate or to cause water to reach the baseplate through pinholes therein. As a result, the baseplate may suffer corrosion, or the film layer may be swollen to be separated from the baseplate.

SUMMARY OF THE INVENTION

The object of this invention is to provide a radiation base of an electric appliance in which a resin mold layer with low friction property, nonviscousness and heat resistance is integrally formed on a predetermined surface region of a metallic baseplate by the injection molding method using a mold.

DETAILED DESCRIPTION OF THE PREFERRED EMBODIMENT

Figure 1:
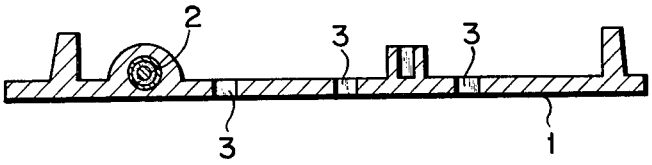
FIG. 1 is a sectional view of a baseplate of a radiation base of an electric appliance according to an embodiment of this invention.
Figure 2:
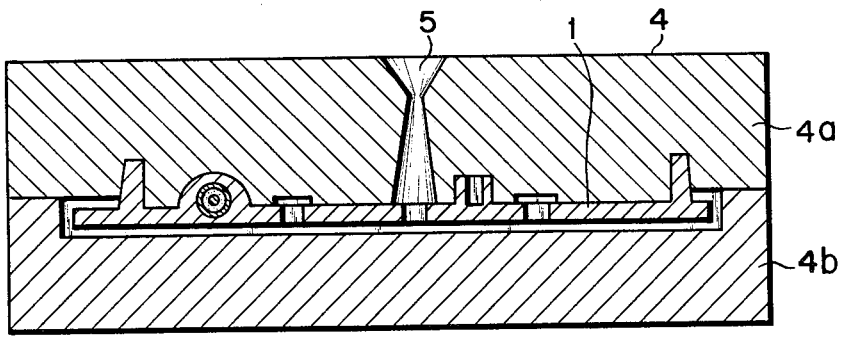
FIG. 2 is a sectional view of a mold for illustrating the manner of injection molding.
Figure 3:
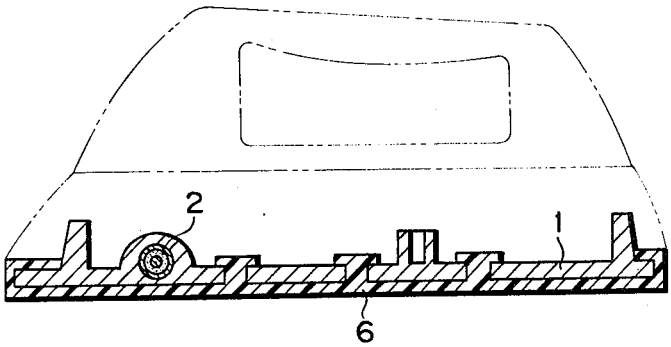
FIG. 3 is a sectional view of a molded radiation base.

Now there will be described an embodiment of this invention with reference to the accompanying drawings. Referring to FIG. 1, there is shown a baseplate 1 of e.g. an iron which is molded by aluminum die casting. A heat generating body 2 such as a sheath heater is embedded in one side portion of the baseplate 1, and a plurality of perforations 3 are formed in the central portion of the plate 1. As shown in FIG. 2, the baseplate 1 is contained in a mold 4 for injection molding. The mold 4 is formed of upper and lower halves 4*a* and 4*b*. An injection hole 5 is bored through the upper half 4*a*. The baseplate 1 is attracted to the upper surface of the cavity in the upper half 4*a* by vacuum suction. There is a given space between the under surface of the baseplate 1 and the bottom surface of the cavity of the lower half 4*b*, and one of the perforations 3 faces the injection hole 5.

In this state, resin with low friction property, nonviscousness and heat resistance, such as polyphenylene sulfide resin, phenolic resin or fluoric resin, is injected through the injection hole 5 into the mold 4 to form a resin mold layer 6 on the under surface and the peripheral edge of the baseplate 1. At this time, part of the resin flows into the perforations 3 of the baseplate 1 to swell out on the top side of the baseplate 1, so that the resin mold layer 6 is united firmly with the baseplate 1. Thereafter, the baseplate 1 is removed from the mold 4, and thus the molding of an integral radiation base is completed. In this radiation base, the resin mold layer 6 is used as a heat radiating surface, that is, a surface to be in contact with cloth being ironed.

In the radiation base of such construction, moreover, the resin mold layer 6 is formed by the injection molding method different from the conventional coating method, so that setting wrinkles or blowholes on the baseplate 1, if any, becomes no special problem. Therefore, the baseplate 1 requires no cutting work. The conventional coating method requires complicated working processes including degreasing and baking of the cut surface of the baseplate 1 and coating and firing of resin, as well as the cutting or machining work on the baseplate 1, and hence requires high equipment cost. According to this invention, on the other hand, the resin mold layer 6 is formed by the injection molding method using a mold which requires relatively simple processes and equipment, so that improvement of operating efficiency and reduction of cost can be achieved. Unlike a film layer formed by coating, moreover, the resin mold layer 6 may easily obtain a sufficient thickness, and may therefore be free from abrasion and pinholes. Thus, the baseplate 1 can be protected from exposure and penetration of water and hence be improved in durability.

The baseplate need not always have perforations. Now there will be described a preferred modification of the baseplate.

Figure 4:
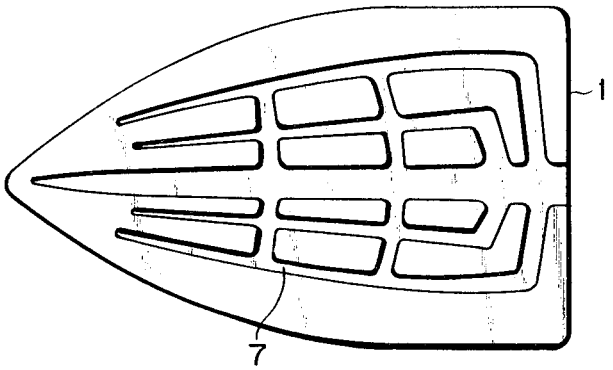
FIG. 4 is a plan view showing a modification of the baseplate.
Figure 5:
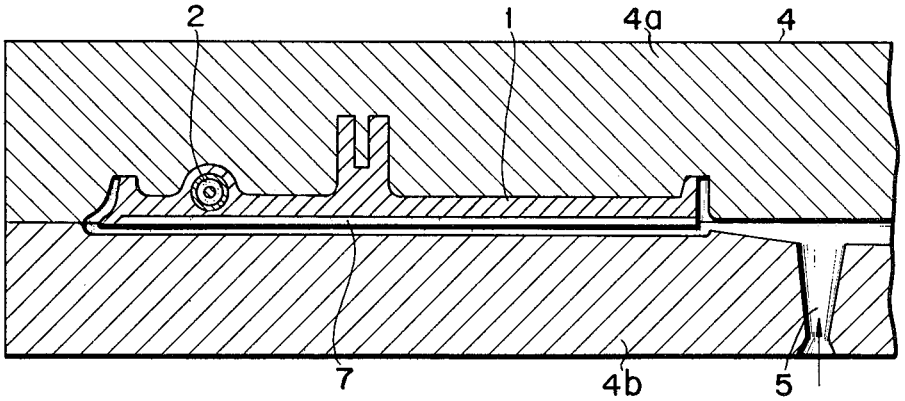
FIG. 5 is a sectional view of a mold for forming a resin mold layer on the baseplate of FIG. 4 by the injection molding method.
Figure 6:
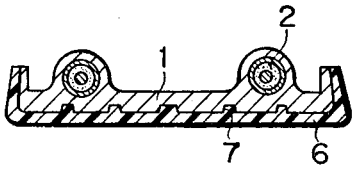
FIG. 6 is a sectional view of a molded radiation base.

A baseplate 1 shown in FIG. 4 has a guide groove 7 on its under surface which divergently extends to spread substantially uniformly over the under surface. In forming a resin mold layer on the under surface of such baseplate 1, as shown in FIG. 5, a mold 4 with an injection hole 5 bored through its lower half 4*b* is used. In this case, resin is injected through the injection hole 5 into a gap between the under surface of the baseplate 1 and the lower half 4*b* of the mold 4 with the baseplate 1 held against the cavity wall of the upper half 4*a* of the mold 4 by suction. The injected resin reaches every part of the gap through the guide groove 7 even though the gap is narrow. Thus, a resin mold layer 6 is formed over the whole under surface of the baseplate 1, as shown in FIG. 6.

Figure 7:
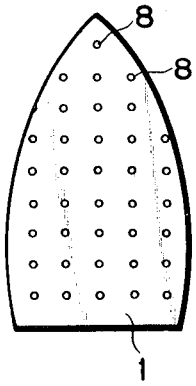
FIG. 7 is a plan view showing further modification of the baseplate.

A baseplate 1 shown in FIG. 7 has a multitude of projections 8 arranged at regular intervals over substantially the whole under surface thereof. These projections 8 may be formed as follows.

Figure 8A:
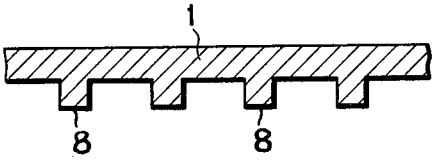
FIGS. 8A to 8C are sectional views for illustrating the modification of the present invention.
Figure 8B:
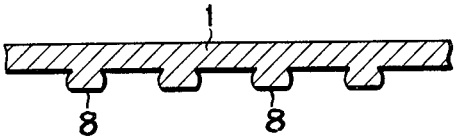
Figure 8C:
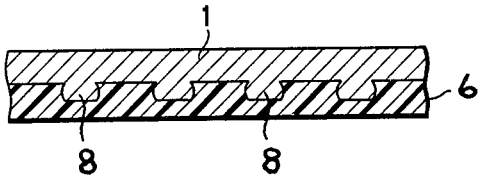

As shown in FIG. 8A, a baseplate 1 with a multitude of cylindrical projections 8 integrally formed on its under surface is formed by die casting using aluminum alloy as material. These projections 8 are axially pressurized by means of a press to be worked into barrel-shaped projections 8 bulging in the middle of their circumferential surfaces, as shown in FIG. 8B. Applicable to the press is one which is intended to break up the remains of casting gate or vent hole or flashes usually remaining on the peripheral edge of the baseplate 1 after die casting. When the resin mold layer 6 is formed on the under surface of the baseplate 1 with these projections 8 by the injection molding method, as shown in FIG. 8C, part of the resin mold layer 6 encroaches upon the regions around the basal part of the projections 8, thereby ensuring good conjunction between the mold layer 6 and the baseplate 1.

Although the radiation base is applied to a common iron in the above embodiment, it may also be applied to a steam iron with a multitude of steam ports formed in its baseplate. In this case, the resin mold layer may be formed also on the inner peripheral surfaces of the steam ports by the use of the injection molding method. Unlike the prior art method in which the resin mold layer is formed by coating, therefore, the injection molding method can prevent corrosion from starting at the inner peripheral surfaces of the steam ports.

Further, the thickness of the resin mold layer formed by injection molding can partially be made free by fixing the shapes of the mold and the baseplate. In the steam iron, for example, the portion of the baseplate under a vaporizing chamber is liable to become lower in temperature than the remaining portion. For uniform temperature distribution on the under surface of the resin mold layer, therefore, the portion of the baseplate under the vaporizing chamber is somewhat projected downward so that the portion of the resin mold layer corresponding to such projected portion is formed thinner than the remaining portion thereof for the flatness of the under surface of the resin mold layer.

Heating means need not be used for injection molding of the baseplate if the baseplate is injection-molded immediately after it has been molded by die casting and its temperature is about 200° C. This is because the injection molding can be achieved at about 200° C. In case the baseplate is cooled to a temperature much lower than 200° C., heating means is of course necessary. In this case, energy can be saved unless the baseplate is cooled to room temperature or a lower temperature.

The method of molding the baseplate is not limited to the aluminum die casting, and the baseplate may be molded by mechanically working aluminum or other metal material. Further, this invention may be applied to the radiation bases of cooking plates and the like, as well as to the radiation base of the iron.

According to this invention, as described above, a radiation base is manufactured by forming a resin mold layer with low friction property, nonviscousness and heat resistance over a predetermined surface region of a metallic baseplate by an injection molding method using a mold. Thus, a highly durable radiation base can be efficiently manufactured at low cost.

What is claimed as new and desired to be secured by Letters Patent of the United States is:

1. A radiation base for an electric appliance, said radiation base comprising:

(a) an injection-molded layer formed of a low friction, nonviscous, heat resistant synthetic resin and (b) a metallic base plate integrally attached to one side of said injection-molded layer, said base plate having a plurality of projections formed on the side thereof to which said injection-molded layer is attached to ensure good conjunction between said base plate and said injection-molded layer, said plurality of projections having bulges in their middles, whereby said injection-molded layer protrudes in between the adjacent surface of said base plate and said bulges in said plurality of projections to further ensure good conjunction between said base plate and said injection-molded layer.

2. A radiation base as recited in claim 1 wherein said synthetic resin is selected from the group consisting of polyphenylene sulfide resin, phenolic resin, and fluoric resin.

* * * * *